US011739490B2

(12) United States Patent
Ayers

(10) Patent No.: US 11,739,490 B2
(45) Date of Patent: Aug. 29, 2023

(54) DOUBLE EDGE UNDERGROUND BASE FOR STATIC STRUCTURE

(71) Applicant: Ryan Ayers, Sandyston, NJ (US)

(72) Inventor: Ryan Ayers, Sandyston, NJ (US)

( * ) Notice: Subject to any disclaimer, the term of this patent is extended or adjusted under 35 U.S.C. 154(b) by 382 days.

(21) Appl. No.: 17/138,967

(22) Filed: Dec. 31, 2020

(65) Prior Publication Data

US 2022/0205205 A1 Jun. 30, 2022

(51) Int. Cl.

| | |
|---|---|
| ***E02D 5/22*** | (2006.01) |
| ***E02D 5/28*** | (2006.01) |
| ***E02D 27/12*** | (2006.01) |
| *E02D 7/10* | (2006.01) |

(52) U.S. Cl.

CPC ..... *E02D 5/223* (2013.01); *E02D 5/285* (2013.01); *E02D 7/10* (2013.01); *E02D 2250/00* (2013.01); *E02D 2300/0032* (2013.01)

(58) Field of Classification Search

CPC ..... E02D 5/48; E02D 5/223; E02D 5/285; E02D 5/523; E02D 2300/0032; E02D 2200/1642; E02D 2600/40; E02D 27/42; E02D 7/10; E02D 2250/00; E02D 3/12

See application file for complete search history.

(56) References Cited

U.S. PATENT DOCUMENTS

| | | | | |
|---|---|---|---|---|
| 4,603,520 | A * | 8/1986 | Deike | E04H 17/08 52/157 |
| 10,287,742 | B2 * | 5/2019 | Tappe | E02D 27/32 |
| 2014/0237913 | A1 * | 8/2014 | Kronz | E02D 27/42 52/741.15 |
| 2016/0168816 | A1 * | 6/2016 | Pope | E02D 5/223 52/292 |
| 2018/0080189 | A1 * | 3/2018 | Reinert | E02D 27/10 |
| 2018/0347136 | A1 * | 12/2018 | Koman | E02D 5/285 |

FOREIGN PATENT DOCUMENTS

| | | | | |
|---|---|---|---|---|
| KR | 2019007790 A * | 1/2019 | | E01D 19/00 |
| WO | WO-2016187615 A1 * | 11/2016 | | |

* cited by examiner

*Primary Examiner* — Benjamin F Fiorello
*Assistant Examiner* — Stacy N Lawson
(74) *Attorney, Agent, or Firm* — The Webb Law Firm

(57) ABSTRACT

An underground base configured for supporting an above-ground static structure that has a pair of plates each having a distal end, a proximal end, and a body portion between the distal end and the proximal end. The pair of plates are connected to each other to define a box section and a pair of flanges extending outwardly from opposing vertices of the box section. The base further has a plurality of brackets each connected to one of the plates at the proximal end, a base plate connected to the plurality of brackets, and an adjustment plate connected to the base plate via one or more adjustment fasteners. The adjustment plate is movable relative to the base plate via the one or more adjustment fasteners to adjust an orientation of the adjustment plate relative to the base plate.

19 Claims, 5 Drawing Sheets

DOUBLE EDGE UNDERGROUND BASE FOR STATIC STRUCTURE

BACKGROUND OF THE DISCLOSURE

Field of the Disclosure

The present application relates generally to supports for static structures and methods for installing the supports, such as underground bases for aboveground static structures and methods for installing such underground bases.

Technical Considerations

Various commercial static structures, such as utility poles in the power transmission industry and lattice towers in the cellular telephone industry, are supported on an underground base. Typically, a conventional underground base is made of concrete. Such concrete bases are associated with a number of disadvantages, including the cost of installation, logistical challenges of getting the concrete mixed, poured, and cured in remote or inaccessible locations where static structures are often installed, and difficulty of installation in inclement weather. Some underground bases are made of steel and are driven into the soil using pressure, such as a hydraulic press.

Load requirements for an underground base are determined based on the size and weight of the static structure that the base must support, various static and dynamic loads that the static structure may experience, such as the weight of power cables attached to the static structure, wind load, or earthquake, and the composition of the underlying soil in which the underground structure is to be installed. A factor of safety is added, which further increases the weight of the underground bases. The increased weight leads to an increase in cost in making, transporting, and installing the underground base. In view of the disadvantages of existing underground bases, it would be desirable to reduce the weight of an underground base for a static structure while meeting the load requirements.

SUMMARY OF THE DISCLOSURE

Accordingly, provided is an improved underground base and a method for installing the underground base that overcomes the deficiencies of the prior art.

In some non-limiting embodiments or aspects, an underground base may be configured for supporting an above-ground static structure. The underground base may include a pair of plates each having a distal end, a proximal end, and a body portion between the distal end and the proximal end. The pair of plates may be connected to each other to define a box section and a pair of flanges extending outwardly from opposing vertices of the box section. The underground base further may include a plurality of brackets each connected to one of the plates at the proximal end; a base plate connected to the plurality of brackets; and an adjustment plate connected to the base plate. The adjustment plate may be movable relative to the base plate via one or more adjustment fasteners to adjust an orientation of the adjustment plate relative to the base plate.

In some non-limiting embodiments or aspects, the pair of plates may be connected to each other along at least a portion of a longitudinal length of the plates by a plurality of fasteners extending at least along the pair of flanges.

In some non-limiting embodiments or aspects, the pair of plates may be connected to each other along at least a portion of a longitudinal length of the plates by one or more welds at least along the pair of flanges.

In some non-limiting embodiments or aspects, the pair of plates may be connected to each other along at least a portion of a longitudinal length of the plates by an adhesive at least along the pair of flanges.

In some non-limiting embodiments or aspects, the plates may be made from carbon steel.

In some non-limiting embodiments or aspects, each of the plates may include a first bend line between the proximal end and the distal end extending along a longitudinal length of the body portion; and a pair of second bend lines between the proximal end and the distal end extending along the longitudinal length of the body portion.

In some non-limiting embodiments or aspects, the first bend line may be positioned between the pair of second bend lines.

In some non-limiting embodiments or aspects, the first bend line may be substantially parallel to the pair of second bend lines.

In some non-limiting embodiments or aspects, the first bend line may define an angle of 45°, and each of the pair of second bend lines may define an angle of 45°.

In some non-limiting embodiments or aspects, the distal end of each of plates may taper at the flanges at an angle of 45° to 60°.

In some non-limiting embodiments or aspects, each of the plurality of brackets may include a bracket distal end; a bracket proximal end; a bracket body portion between the bracket proximal end and the bracket distal end; a first bend line between the bracket proximal end and the bracket distal end extending along a longitudinal length of the bracket body portion; a second bend line between the bracket proximal end and the bracket distal end extending along the longitudinal length of the bracket body portion; and a flap at the bracket proximal end.

In some non-limiting embodiments or aspects, the first bend line and the second bend line each may extend along a full longitudinal length of the bracket.

In some non-limiting embodiments or aspects, the flap may define a third bend line that is substantially perpendicular to the first bend line and the second bend line.

In some non-limiting embodiments or aspects, the first bend line may define an angle of 45° between a first portion and a second portion of the bracket body portion, and the second bend line may define an angle of 45° between the first portion and a third portion of the bracket body portion.

In some non-limiting embodiments or aspects, each of the plurality of brackets further may include one or more gussets extending from the bracket body portion to the flap.

In some non-limiting embodiments or aspects, the base plate may at least partially enclose an open top end at the proximal end of the base.

In some non-limiting embodiments or aspects, the base plate may define a plurality of holes for receiving the one or more adjustment fasteners.

In some non-limiting embodiments or aspects, the adjustment plate may have a support surface configured for supporting at least a portion of the static structure.

In some non-limiting embodiments or aspects, the one or more adjustment fasteners may include a threaded bolt and a pair of threaded nuts positioned on opposing sides of the adjustment plate.

In some non-limiting embodiments or aspects, an underground base configured for supporting an above-ground static structure may include a pair of plates each having a distal end, a proximal end, and a body portion between the distal end and the proximal end. The pair of plates may be connected to each other to define a box section and a pair of flanges extending outwardly from opposing vertices of the box section. Each of the plates may include a first bend line between the proximal end and the distal end extending along a longitudinal length of the body portion; and a pair of second bend lines between the proximal end and the distal end extending along the longitudinal length of the body portion. The first bend line may be positioned between the pair of second bend lines; a plurality of brackets each connected to one of the plates at the proximal end; a base plate connected to the plurality of brackets; and an adjustment plate connected to the base plate. The adjustment plate may be movable relative to the base plate via one or more adjustment fasteners to adjust an orientation of the adjustment plate relative to the base plate.

Further non-limiting embodiments or aspects are set forth in the following numbered clauses:

Clause 1. An underground base configured for supporting an above-ground static structure, the underground base comprising: a pair of plates each having a distal end, a proximal end, and a body portion between the distal end and the proximal end, the pair of plates being connected to each other to define a box section and a pair of flanges extending outwardly from opposing vertices of the box section; a plurality of brackets each connected to one of the plates at the proximal end; a base plate connected to the plurality of brackets; and an adjustment plate connected to the base plate, wherein the adjustment plate is movable relative to the base plate via one or more adjustment fasteners to adjust an orientation of the adjustment plate relative to the base plate.

Clause 2. The underground base according to clause 1, wherein the pair of plates are connected to each other along at least a portion of a longitudinal length of the plates by a plurality of fasteners extending at least along the pair of flanges.

Clause 3. The underground base according to clause 1 or 2, wherein the pair of plates are connected to each other along at least a portion of a longitudinal length of the plates by one or more welds at least along the pair of flanges.

Clause 4. The underground base according to any of clauses 1-3, wherein the pair of plates are connected to each other along at least a portion of a longitudinal length of the plates by an adhesive at least along the pair of flanges.

Clause 5. The underground base according to any of clauses 1-4, wherein the plates are made from carbon steel.

Clause 6. The underground base according to any of clauses 1-5, wherein each of the plates comprises: a first bend line between the proximal end and the distal end extending along a longitudinal length of the body portion; and a pair of second bend lines between the proximal end and the distal end extending along the longitudinal length of the body portion.

Clause 7. The underground base according to any of clauses 1-6, wherein the first bend line is positioned between the pair of second bend lines.

Clause 8. The underground base according to any of clauses 1-7, wherein the first bend line is substantially parallel to the pair of second bend lines.

Clause 9. The underground base according to any of clauses 1-8, wherein the first bend line defines an angle of 45°, and wherein each of the pair of second bend lines defines an angle of 45°.

Clause 10. The underground base according to any of clauses 1-9, wherein the distal end of each of the plates tapers at the flanges at an angle of 45° to 60°.

Clause 11. The underground base according to any of clauses 1-10, wherein each of the plurality of brackets comprises: a bracket distal end; a bracket proximal end; a bracket body portion between the bracket proximal end and the bracket distal end; a first bend line between the bracket proximal end and the bracket distal end extending along a longitudinal length of the bracket body portion; a second bend line between the bracket proximal end and the bracket distal end extending along the longitudinal length of the bracket body portion; and a flap at the bracket proximal end.

Clause 12. The underground base according to any of clauses 1-1, wherein the first bend line and the second bend line each extend along a full longitudinal length of the bracket.

Clause 13. The underground base according to any of clauses 1-12, wherein the flap defines a third bend line that is substantially perpendicular to the first bend line and the second bend line.

Clause 14. The underground base according to any of clauses 1-13, wherein the first bend line defines an angle of 45° between a first portion and a second portion of the bracket body portion, and wherein the second bend line defines an angle of 45° between the first portion and a third portion of the bracket body portion.

Clause 15. The underground base according to any of clauses 1-14, wherein each of the plurality of brackets further comprises one or more gussets extending from the bracket body portion to the flap.

Clause 16. The underground base of any of clauses 1-15, wherein the base plate at least partially encloses an open top end at the proximal end of the base.

Clause 17. The underground base according to any of clauses 1-16, wherein the base plate defines a plurality of holes for receiving the one or more adjustment fasteners.

Clause 18. The underground base according to any of clauses 1-17, wherein the adjustment plate has a support surface configured for supporting at least a portion of the static structure.

Clause 19. The underground base according to any of clauses 1-18, wherein the one or more adjustment fasteners comprise a threaded bolt and a pair of threaded nuts positioned on opposing sides of the adjustment plate.

Clause 20. An underground base configured for supporting an above-ground static structure, the underground base comprising a pair of plates each having a distal end, a proximal end, and a body portion between the distal end and the proximal end, the pair of plates being connected to each other to define a box section and a pair of flanges extending outwardly from opposing vertices of the box section, wherein each of the plates comprises: a first bend line between the proximal end and the distal end extending along a longitudinal length of the body portion; and a pair of second bend lines between the proximal end and the distal end extending along the longitudinal length of the body portion, wherein the first bend line is positioned between the pair of second bend lines; a plurality of brackets each connected to one of the plates at the proximal end; a base plate connected to the plurality of brackets; and an adjustment plate connected to the base plate, wherein the adjustment plate is movable relative to the base plate via one or more adjustment fasteners to adjust an orientation of the adjustment plate relative to the base plate.

These and other features and characteristics of the present disclosure, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the disclosure.

BRIEF DESCRIPTION OF THE DRAWINGS

Additional advantages and details of the disclosure are explained in greater detail below with reference to the exemplary embodiments or aspects that are illustrated in the accompanying schematic figures, in which.

DETAILED DESCRIPTION OF THE DISCLOSURE

Figure 1:
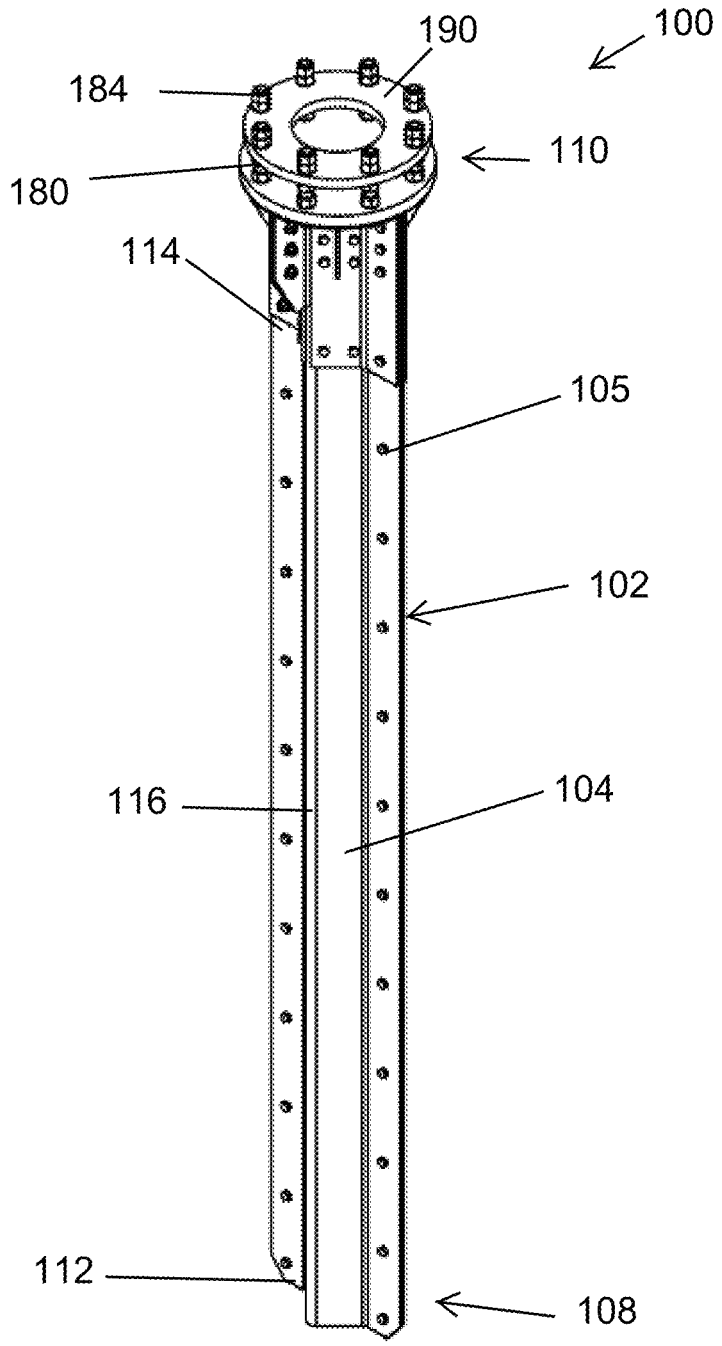
FIG. 1 is a perspective view of an underground base for a static structure according to one embodiment or aspect of the present disclosure.

As used herein, the singular form of "a", "an", and "the" include plural referents unless the context clearly dictates otherwise.

Spatial or directional terms, such as "left", "right", "inner", "outer", "above", "below", and the like, relate to the embodiments or aspects as shown in the drawing figures and are not to be considered as limiting as the embodiments or aspects can assume various alternative orientations.

All numbers used in the specification and claims are to be understood as being modified in all instances by the term "about". By "about" is meant within plus or minus twenty-five percent of the stated value. However, this should not be considered as limiting to any analysis of the values under the doctrine of equivalents.

Unless otherwise indicated, all ranges or ratios disclosed herein are to be understood to encompass the beginning and ending values and any and all subranges or subratios subsumed therein. For example, a stated range or ratio of "1 to 10" should be considered to include any and all subranges or subratios between (and inclusive of) the minimum value of 1 and the maximum value of 10; that is, all subranges or subratios beginning with a minimum value of 1 or more and ending with a maximum value of 10 or less. The ranges and/or ratios disclosed herein represent the average values over the specified range and/or ratio.

The terms "first", "second", and the like are not intended to refer to any particular order or chronology, but refer to different conditions, properties, or elements.

All documents referred to herein are "incorporated by reference" in their entirety.

The term "at least" is synonymous with "greater than or equal to".

As used herein, "at least one of" is synonymous with "one or more of". For example, the phrase "at least one of A, B, or C" means any one of A, B, or C, or any combination of any two or more of A, B, or C. For example, "at least one of A, B, and C" includes A alone; or B alone; or C alone; or A and B; or A and C; or B and C; or all of A, B, and C.

The term "includes" is synonymous with "comprises".

As used herein, the terms "parallel" or "substantially parallel" mean a relative angle as between two objects (if extended to theoretical intersection), such as elongated objects and including reference lines, that is from 0° to 5°, or from 0° to 3°, or from 0° to 2°, or from 0° to 1°, or from 0° to 0.5°, or from 0° to 0.25°, or from 0° to 0.1°, inclusive of the recited values.

As used herein, the terms "perpendicular" or "substantially perpendicular" mean a relative angle as between two objects at their real or theoretical intersection is from 85° to 90°, or from 87° to 90°, or from 88° to 90°, or from 89° to 90°, or from 89.5° to 90°, or from 89.75° to 90°, or from 89.9° to 90°, inclusive of the recited values.

The discussion of various examples or aspects may describe certain features as being "particularly" or "preferably" within certain limitations (e.g., "preferably", "more preferably", or "even more preferably", within certain limitations). It is to be understood that the disclosure is not limited to these particular or preferred limitations but encompasses the entire scope of the various examples and aspects described herein.

The disclosure comprises, consists of, or consists essentially of, the following examples or aspects, in any combination. Various examples or aspects of the disclosure are illustrated in separate drawing figures. However, it is to be understood that this is simply for ease of illustration and discussion. In the practice of the disclosure, one or more examples or aspects shown in one drawing figure can be combined with one or more examples or aspects shown in one or more of the other drawing figures.

With reference to FIG. 1, an underground base 100 (hereinafter referred to as "base 100") configured for supporting above-ground static structures is shown in accordance with one embodiment or aspect of the present disclosure. The underground base 100 is configured for underground installation by being hydraulically pushed or otherwise driven into the soil. For example, the base 100 may be configured for being pushed or otherwise driven into the soil by a hydraulic ram. In some embodiments or aspects, at least a portion of a longitudinal length of the base 100 is configured for being installed underground. In some embodiments or aspects, the base 100 may be configured for supporting an above-ground static structure, such as a utility pole used in the power transmission industry. In this manner, at least a portion of the base 100 may be exposed from the ground to allow for connection of the above-ground static structure to the base 100. The base 100 may be construed as a single-piece structure (FIG. 1), or as a plurality of separate structures that are joined together at a joint to form the base (not shown). In this manner, the separate structures can be made to have a shorter length for easier transport, and then assembled on site for final installation as a full-length base.

The base 100 provides a lightweight structure compared to conventional reinforced concrete bases while meeting the same load and soil support requirements as the concrete bases. The reduced weight of the base 100 compared to conventional concrete bases allows the base to be easily and efficiently transported to the installation site. Additionally, the base 100 can be installed into the soil in a matter of hours and does not require lengthy curing times associated with pouring conventional concrete bases. Unlike the concrete bases, the installation of the base 100 is not dependent on the weather conditions.

With reference to FIG. 1, the base 100 has a body 102 made from a pair of plates 104 that are connected together to define a three-dimensional structure that defines an outer shape of the base 100. In some embodiments or aspects, the plates 104 are connected to each other via one or more fasteners 105. In other embodiments or aspects, the plurality of plates 104 are connected to each other via welding, adhesive, fasteners, and any combination thereof.

Figure 4:
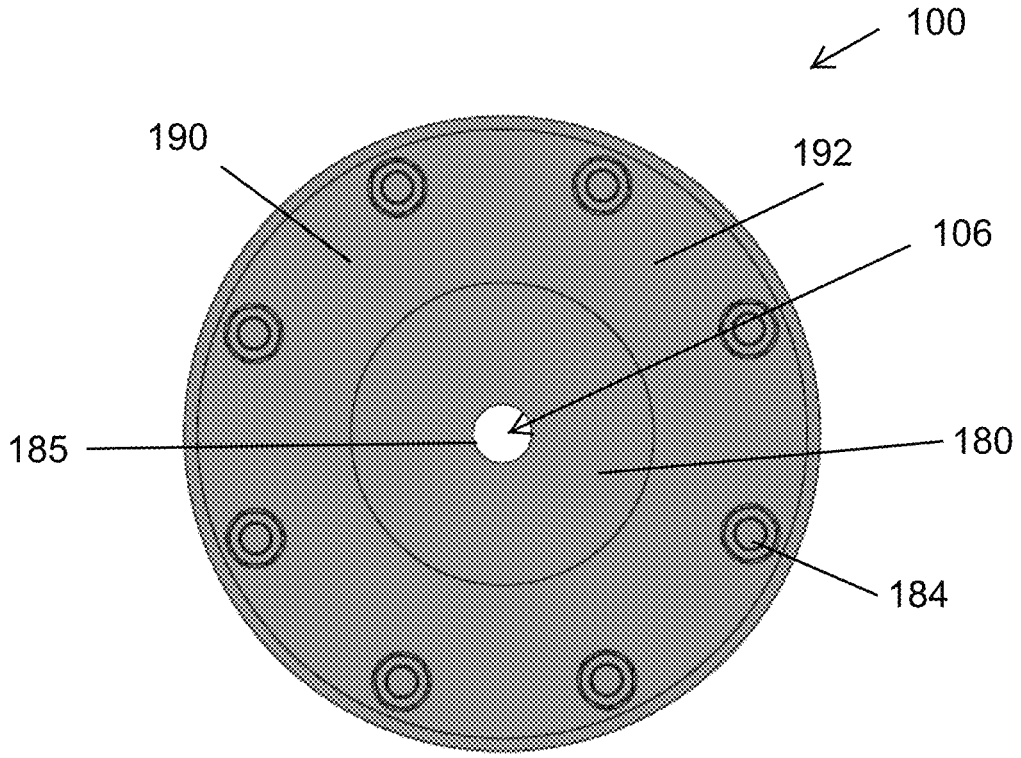
FIG. 4 is a top view of the underground base shown in FIG. 1.

With continued reference to FIG. 1, the plates 104 may be identical to each other. In some embodiments or aspects, at least one of the plates 104 may be different from the remaining plates 104. In some embodiments or aspects, the plates 104 may be arranged to define various cross-sectional shapes of the base 100. For example, the plates 104 may define a substantially square cross-sectional shape with a pair of flanges extending from opposing vertices of the square (see FIG. 8). The three-dimensional structure defined by the plurality of plates 104 has an open top end 106 (shown in FIG. 4) and an open bottom end (shown in FIG. 5). The size and shape of the base 100 is desirably selected to meet the load requirements for the above-ground static structure that will be supported by the base 100. The wider that a diameter of the base 100 is, the better suited the base 100 is for withstanding an overturning moment force to prevent the static structure from tipping over.

With continued reference to FIG. 1, the base 100 has a distal portion 108 that is configured to be furthest from the soil surface when the base 100 is installed in the soil and an opposite proximal portion 110 that is configured to be closest to the soil surface (i.e. slightly above, at the same level, or slightly below).

With continued reference to FIG. 1, each of the plates 104 has a first or distal end 112, a second or proximal end 114, and a body portion 116 extending between the distal end 112 and the proximal end 114. The plates 104 may be connected to each other along at least a portion of a longitudinal length of the body portion 116. For example, the plates 104 may be connected to each other along an entire longitudinal length of the body portion 116. Each of the plates 104 may be made from the same material or a different material. The plates 104 may be made from a planar or sheet stock. In some embodiments or aspects, each of the plates 104 is made from a first material, such as steel. The steel may be carbon steel. Each plate 104 may have a thickness of 0.5" to 1.0".

Figure 7:
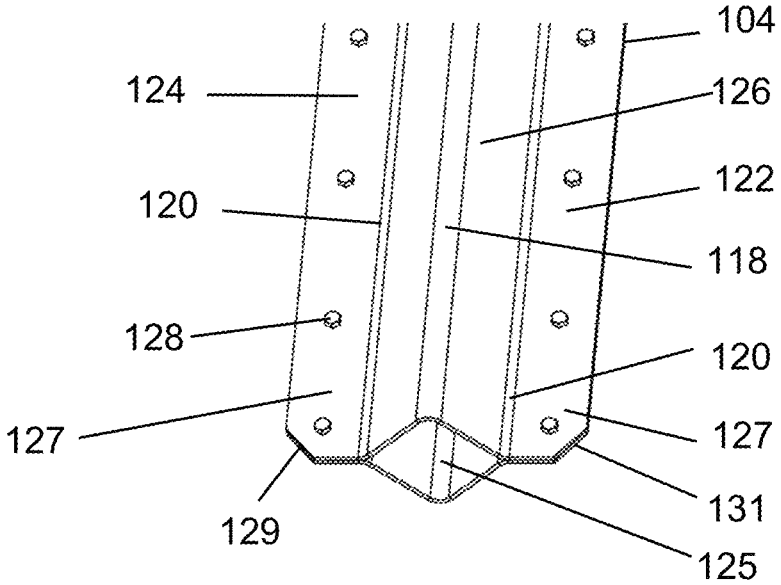
FIG. 7 is a detailed perspective view of a bottom portion of the underground base shown in FIG. 1.

With reference to FIG. 7, each plate 104 has a first bend line 118 between the proximal end 114 and the distal end 112 extending along a longitudinal length of the body portion 116. The first bend line 118 may be at an approximate midpoint of the plate 104 in a lateral direction. Each plate 104 further has a pair of second bend lines 120 between the proximal end 114 and the distal end 112 extending along the longitudinal length of the body portion 116. The second bend lines are spaces equidistant from the first bend line 118. The first bend line 118 and the second bend lines 120 are substantially parallel to each other and extend along the entire length of the body portion 116. In this manner, the first bend line 118 and the second bend lines 120 divide the body portion 116 into a first flange portion 122, a second flange portion 124, and a central portion 126. In some non-limiting embodiments or aspects, the first bend line 118 may define an angle of 45°, and the second bend lines 120 may define an angle of 45°. The angles defined at the first and second bend lines 116, 118 are determined based on a desired shape of the three-dimensional structure. Each of the first and second flange portions 122, 124 may have a plurality of through holes 128 configured for receiving fasteners 105 (shown in FIG. 1) for connecting the plates 104.

Figure 2:
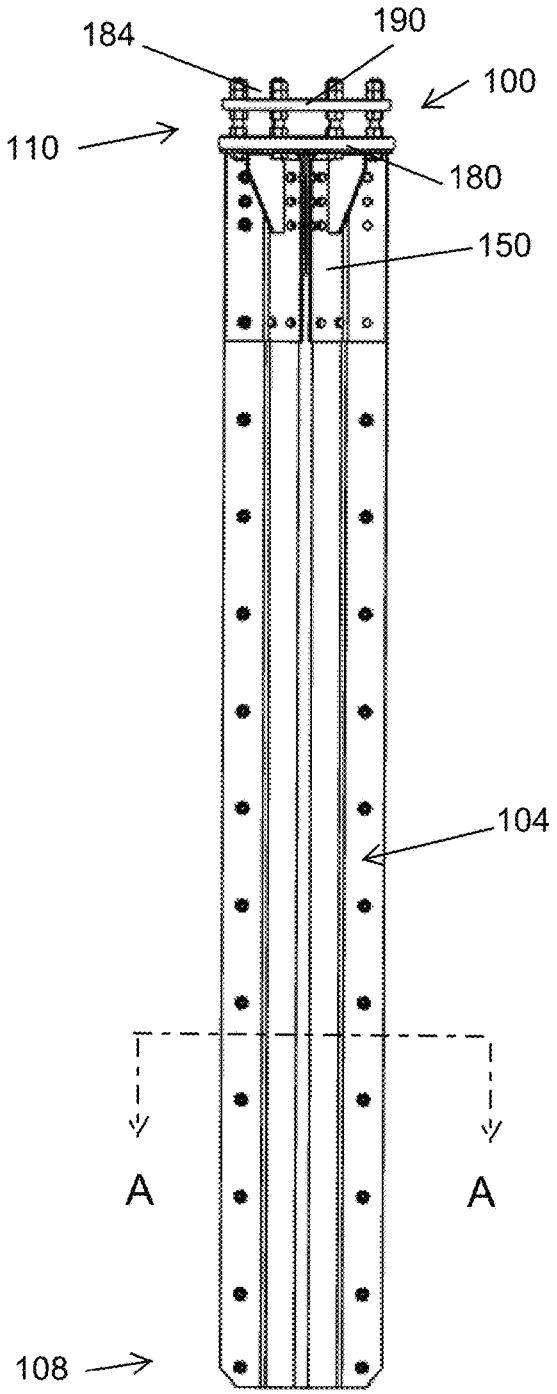
FIG. 2 is a front view of the underground base shown in FIG. 1.
Figure 3:
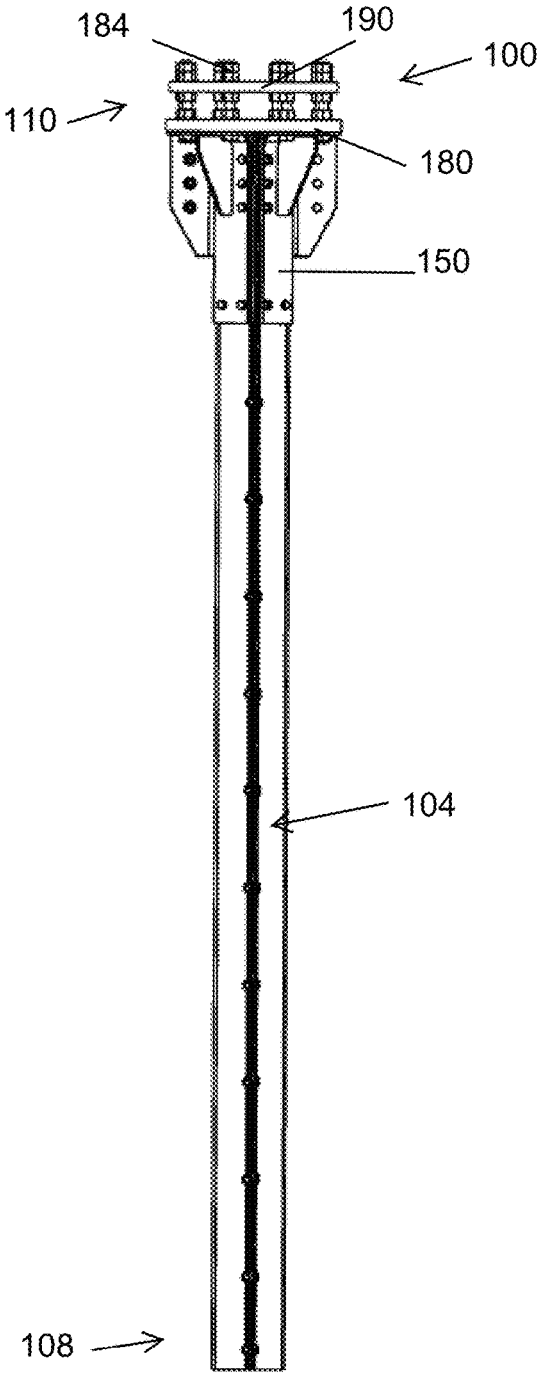
FIG. 3 is a side view of the underground base shown in FIG. 1.
Figure 8:
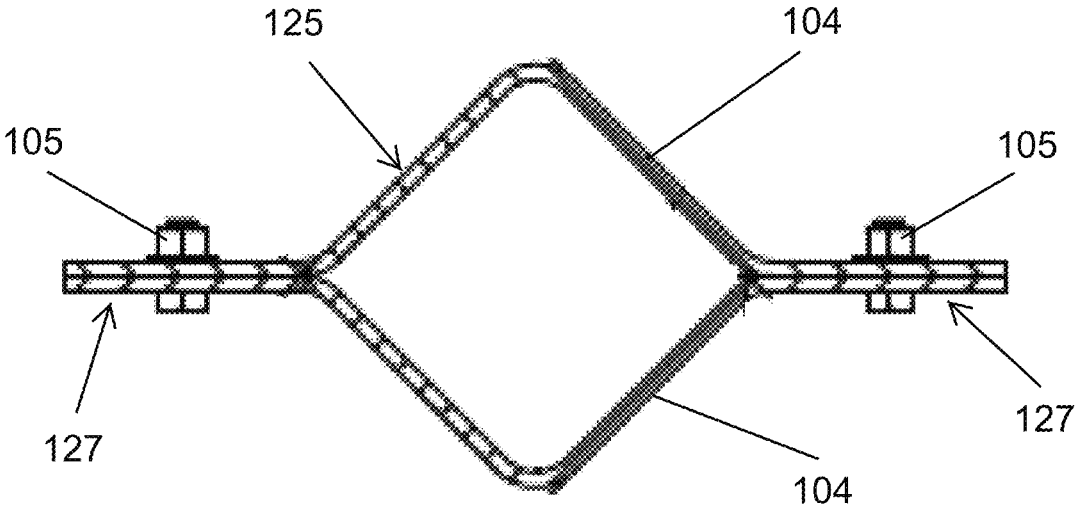
FIG. 8 is a cross-sectional view of the underground base taken along line A-A shown in FIG. 2.

As shown in FIGS. 7-8, when the plates 104 are connected to each other, the body 102 of the base 100 is configured to have a box section 125 defined by the two central portions 126 of the plates 104 and a pair of wings 127 defined by the joined first and second flange portions 122, 124 and extending from opposing vertices of the box section 125. In this manner, the cross-sectional profile of the body 102 is minimized in one direction to allow for installation of the base 100 in soil where existing underground utility lines may be present (see, also FIGS. 2-3). For example, if the existing underground utility lines run in a north-south direction, the base 100 can be installed such that the wings 127 also extend in the north-south direction in order to minimize the potential of striking the utility line during installation of the base 100. When the base 100 is installed underground, the wings 127 provide stability to the base 100 and provide resistance to lateral loads imposed on the proximal end 114 of the base 100.

In some non-limiting embodiments or aspects, and with continued reference to FIG. 7, the distal end 112 of each of the plates 104 may taper at the first and second flange portions 122, 124 to define first and second tapers 129, 131, respectively. In some non-limiting embodiments or aspects, the first taper 129 and the second taper 131 may define an angle of 45° to 60°. The tapered edges defined by the first taper 129 and the second taper 131 make it easier for the base 100 to penetrate the soil during installation and helps reduce the installation costs, since additional equipment, such as a backhoe, dump truck, and related operators and laborers, is not required.

With reference to FIGS. 1-3 and 6, the base 100 further may include a plurality of brackets 150 each connected to one of the plates 104. Each bracket 150 may be configured for connecting to the proximal end 114 of the plate 104. In some embodiments or aspects, the bracket 150 may be connectable to the plate 104 via one or more bracket fasteners 152 (shown in FIG. 6). The brackets 150 may extend along a portion of the longitudinal length of the base 100. For example, the brackets 150 may extend along 5% to 25% of the longitudinal length of the base 100.

Figure 5:
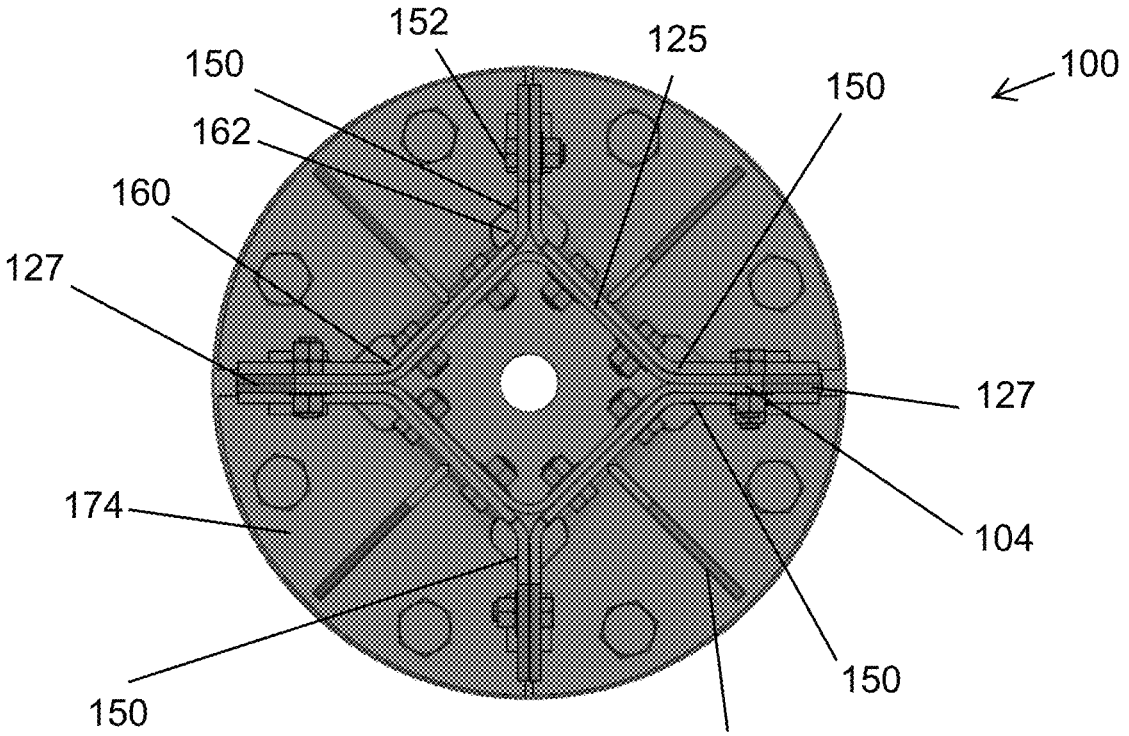
FIG. 5 is a bottom view of the underground base shown in FIG. 1.

Whereas the distal end 118 of the base 100 is configured to have a minimum cross-section to allow for installation of the base 100 in locations with existing underground utility lines, the brackets 150 are configured to maximize the underground cross-section of the base 100 in order to increase stability of the base. As best shown in FIG. 5, the brackets 150 extend outwardly from all four vertices of the box section 125 of the base 100.

Figure 6:
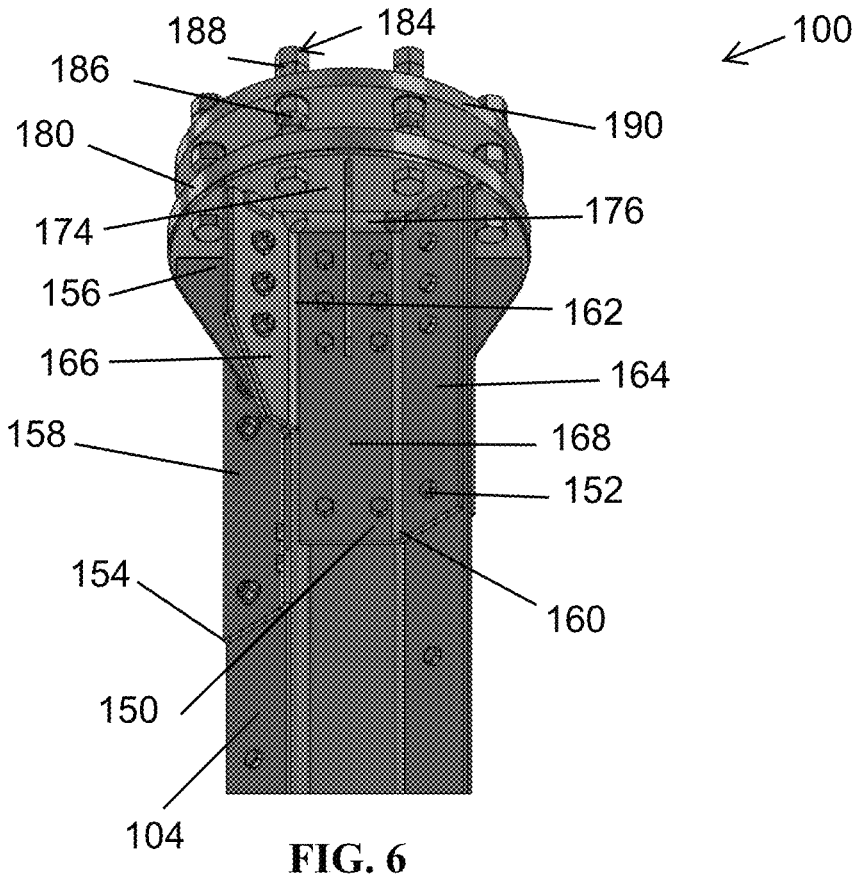
FIG. 6 is a detailed perspective view of a top portion of the underground base shown in FIG. 1.

With reference to FIG. 6, each bracket 150 has a bracket distal end 154, a bracket proximal end 156, a bracket body portion 158 between the bracket proximal end 156 and the bracket distal end 154. The bracket 150 further has a first bend line 160 between the bracket proximal end 156 and the bracket distal end 154 extending along a longitudinal length of the bracket body portion 158, and a second bend line 162 between the bracket proximal end 156 and the bracket distal end 154 extending along a longitudinal length of the bracket body portion 158. The first bend line 160 and the second bend line 162 may be substantially parallel to each other.

The first bend line 160 and the second bend line 162 may extend along the entire length of the bracket body portion 158. In this manner, the first bend line 160 and the second bend line 162 divide the bracket body portion 158 into a first flap portion 164, a second flap portion 166, and a central portion 168. In some non-limiting embodiments or aspects, the first bend line 160 may define an angle of 45° between the first flap portion 164 and the central portion 168, and the second bend line 162 may define an angle of 45° between the second flap portion 166 and the central portion 168. The first and second flap portions 164, 166 and the central portion 168 may have a plurality of through holes configured for receiving the bracket fasteners 152 for connecting the bracket 160 to the plate 104.

With continued reference to FIG. 6, each bracket 150 further has a top flap 174 at the bracket proximal end 156. The top flap 174 defines a third bend line 176. The third bend line 176 may be substantially perpendicular to the first and second bend lines 160, 162. In some embodiments or aspects, a plurality of gussets 172 (shown in FIG. 5) may be connected to the bracket body portion 158 and the top flap 174. The top flap 174 may be configured for supporting a top plate, as further discussed herein.

With continued reference to FIG. 6, a base plate 180 is provided for connecting to the proximal portion 110 of the body 108 of the base 100. The base plate 180 is configured to connect to the plurality of brackets 150 and at least partially encloses the open top end of the base 100 (see FIG. 4). The base plate 180 defines a plurality of holes for receiving one or more adjustment fasteners 184 configured for connecting to an adjustment plate 190. The base plate 180 may be made from the same material as the plurality of plates 104, such as steel. The base plate 180 may have a central opening 185 (shown in FIG. 4).

With continued reference to FIG. 6, the adjustment plate 190 is configured for supporting a static structure on the base 100. In some embodiments or aspects, the adjustment plate 190 includes a support surface 192 configured for supporting at least a portion of the static structure. The adjustment plate 190 is connected to the base plate 180 by one or more adjustment fasteners 184 that permit adjusting a plane defined by the adjustment plate 190 relative to a plane defined by the base plate 180. In this manner, if the base 100 is inserted into the ground at a slight angle such that the plane defined by the base plate 180 is not parallel with the ground surface, the adjustment plate 190 can be angled such that the plane defined by the adjustment plate 190 is parallel with the ground surface. The one or more adjustment fasteners 184 may comprise a threaded bolt 186 and a plurality of nuts 188 positioned on opposing sides of the adjustment plate 190.

Although the present disclosure has been described in detail for the purpose of illustration based on what are currently considered to be the most practical and preferred embodiments or aspects, it is to be understood that such detail is solely for that purpose and that the disclosure is not limited to the disclosed embodiments or aspects, but, on the contrary, is intended to cover modifications and equivalent arrangements that are within the spirit and scope of the appended claims. For example, it is to be understood that the present disclosure contemplates that, to the extent possible, one or more features of any embodiment or aspect can be combined with one or more features of any other embodiment or aspect.

What is claimed is:

1. An underground base configured for supporting an above-ground static structure, the underground base comprising:

a pair of plates each having a distal end, a proximal end, and a body portion between the distal end and the proximal end, the pair of plates being connected to each other to define a box section and a pair of flanges extending outwardly from opposing vertices of the box section;

a plurality of brackets each connected to one of the plates at the proximal end, each of the plurality of brackets comprising:

a bracket distal end;

a bracket proximal end;

a bracket body portion between the bracket proximal end and the bracket distal end;

a first bend line and a second bend line between the bracket proximal end and the bracket distal end extending along a longitudinal length of the bracket body portion, the first bend line and the second bend line dividing the bracket body portion into a first flap portion, a second flap portion, and a central portion;

a base plate connected to the plurality of brackets; and an adjustment plate connected to the base plate, wherein the adjustment plate is movable relative to the base plate via one or more adjustment fasteners to adjust an orientation of the adjustment plate relative to the base plate, and wherein the first flap portion of each of the plurality of brackets is connected to one of the pair of flanges, and the second flap portion of each of the plurality of brackets is connected to the second flap portion of an adjacent one of the plurality of brackets to form a pair of additional flanges extending outwardly from the box section.

2. The underground base according to claim 1, wherein the pair of plates are connected to each other along at least a portion of a longitudinal length of the plates by a plurality of fasteners extending at least along the pair of flanges.

3. The underground base according to claim 1, wherein the pair of plates are connected to each other along at least a portion of a longitudinal length of the plates by one or more welds at least along the pair of flanges.

4. The underground base according to claim 1, wherein the pair of plates are connected to each other along at least a portion of a longitudinal length of the plates by an adhesive at least along the pair of flanges.

5. The underground base according to claim 1, wherein the plates are made from carbon steel.

6. The underground base according to claim 1, wherein each of the plates comprises:

a first bend line between the proximal end and the distal end extending along a longitudinal length of the body portion; and a pair of second bend lines between the proximal end and the distal end extending along the longitudinal length of the body portion.

7. The underground base according to claim 6, wherein the first bend line is positioned between the pair of second bend lines.

8. The underground base according to claim 6, wherein the first bend line is substantially parallel to the pair of second bend lines.

9. The underground base according to claim 6, wherein the first bend line defines an angle of 45°, and wherein each of the pair of second bend lines defines an angle of 45°.

10. The underground base according to claim 1, wherein the distal end of each of the plates tapers at the flanges at an angle of 45° to 60°.

11. The underground base according to claim 1, wherein each of the plurality of brackets comprises a flap at the bracket proximal end.

12. The underground base according to claim 11, wherein the first bend line and the second bend line each extend along the full longitudinal length of the bracket.

13. The underground base according to claim 11, wherein the flap defines a third bend line that is substantially perpendicular to the first bend line and the second bend line.

14. The underground base according to claim 11, wherein the first bend line defines an angle of 45° between the first flap portion and the central portion of the bracket body portion, and wherein the second bend line defines an angle of 45° between the central portion and the second flap portion of the bracket body portion.

15. The underground base according to claim 11, wherein each of the plurality of brackets further comprises one or more gussets extending from the bracket body portion to the flap.

16. The underground base of claim 1, wherein the base plate at least partially encloses an open top end at the proximal end of the base.

17. The underground base according to claim 1, wherein the base plate defines a plurality of holes for receiving the one or more adjustment fasteners.

18. The underground base according to claim 1, wherein the adjustment plate has a support surface configured for supporting at least a portion of the static structure.

19. The underground base according to claim 1, wherein the one or more adjustment fasteners comprise a threaded bolt and a pair of threaded nuts positioned on opposing sides of the adjustment plate.

* * * * *